US005775152A

United States Patent [19]

Daub et al.

[11] Patent Number: 5,775,152

[45] Date of Patent: Jul. 7, 1998

[54] APPARATUS FOR KEEPING COLD STRIP DRY IN THE RUNOUT OF COLD ROLLING PLANTS AND STRIP ROLLING PLANTS

[75] Inventors: Dieter Daub, Hilchenbach; Wolfgang Denker, Frendenberg; Joachim Schmelzer, Olpe, all of Germany

[73] Assignee: SMS Schloemann-Siemag Aktiengesellschaft, Dusseldorf, Germany

[21] Appl. No.: 716,580

[22] Filed: Sep. 19, 1996

[30] Foreign Application Priority Data

Sep. 22, 1995 [DE] Germany ..... 195 35 158.1

[51] Int. Cl.[6] ..... B21C 43/00; B21C 9/00

[52] U.S. Cl. ..... 72/39; 72/236; 134/15; 134/32

[58] Field of Search ..... 15/345; 72/39, 72/40, 202, 236; 134/15, 21, 32, 37

[56] References Cited

U.S. PATENT DOCUMENTS

| | | | |
|---|---|---|---|
| 4,272,976 | 6/1981 | Pizzedaz | 72/236 |
| 4,520,643 | 6/1985 | Werner et al. | 72/39 |
| 4,691,549 | 9/1987 | Adair | 72/39 |
| 5,046,347 | 9/1991 | Crosato et al. | 72/236 |
| 5,473,924 | 12/1995 | Collinson | 72/39 |

FOREIGN PATENT DOCUMENTS 4422422 7/1995 Germany .

*Primary Examiner*—W. Donald Bray
*Attorney, Agent, or Firm*—Friedrich Kueffner

[57] ABSTRACT

An apparatus for keeping cold strip dry in the runout of cold rolling and strip rolling plants includes units for deflecting liquid rolling medium in the area of the strip runout and/or for the removal of spray liquid adhering to the surfaces of the strip, wherein these units are logistically combined, the apparatus including the following components a fixedly installed partition wall having an upper portion above the strip runout extending to the stand platform and a lower portion below the strip runout extending to the base plate, a moveable partition equipped with moveable components for facilitating a problem-free roll exchange, a roll body blower constructed for deflecting squeezed-out rolling medium from the finish-rolled strip, a roll body sealing unit constructed for sealing the roll space above the strip relative to the strip, a strip edge blower constructed for producing an air flow perpendicularly to the strip in the roll gap on the exit side above the strip runout, and a vapor-exhaust unit for producing an air flow extending parallel to the strip travel direction above and below the strip in the strip channel.

8 Claims, 1 Drawing Sheet

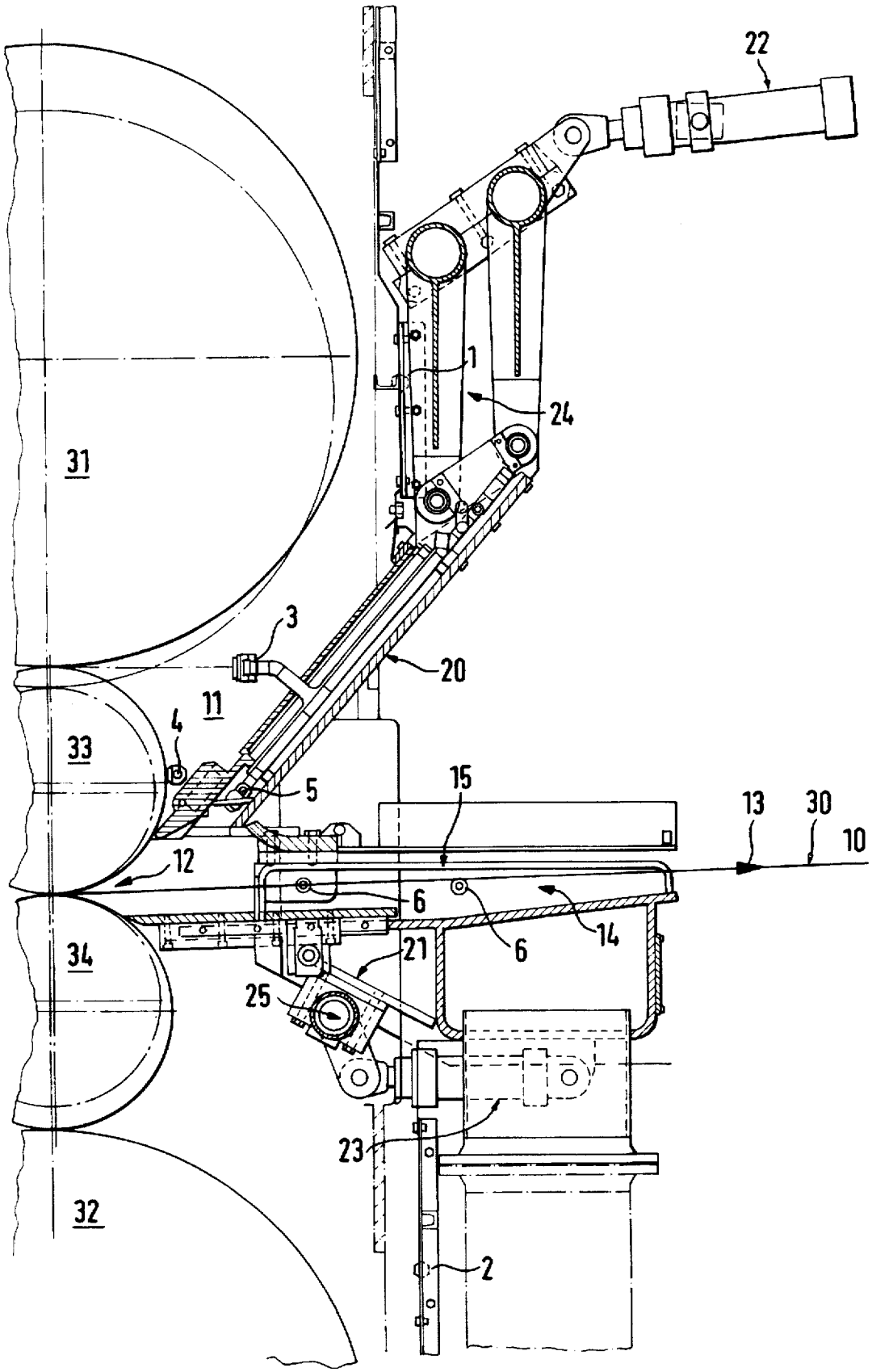
22
1
24
31
3
20
11
4
33
5
15
13
30
10
12
6
14
6
34
21
25
23
32
2

APPARATUS FOR KEEPING COLD STRIP DRY IN THE RUNOUT OF COLD ROLLING PLANTS AND STRIP ROLLING PLANTS

BACKGROUND OF THE INVENTION

1. Field of the Invention

The present invention relates to an apparatus for keeping cold strip dry in the runout of cold rolling plants and strip rolling plants.

2. Description of the Related Art

Among the preferred quality requirements made by manufacturers of the product "cold strip", in addition to good planeness and optimum thickness tolerances, is the requirement that the strip is dry in the runout of cold rolling and strip rolling plants in order to prevent surface defects, for example, spots, for the further processing of the strip.

Various devices and measures are known in the art for achieving a dry strip which is free of wetness and rolling medium. For this purpose, blowing devices, partitions, suction devices as well as combinations of these devices and measures have been used.

For example, DE 44 22 422 A1 discloses a device for the contactless sealing of a gap between a partition and a work roll in the runout of a roll stand which has the following features: a) the partition has a partitioning element at an end thereof which extends approximately tangentially relative to the surface of the work roll and at a relatively small distance from the work roll and from the surface of the rolling stock; b) the partitioning element has at least one supply duct for compressed air connected to a compressed air source, wherein the supply duct opens into a gap nozzle extending in the direction of the roll axis at a small distance along the roll surface; c) an angle defined between the blowing direction of the gap nozzle and a normal line extending from the nozzle opening to the axis of rotation of the work roll is between 0° and 45°, preferably 30°, in the direction of rotation of the roll; d) the partitioning element at the end has at its front side an end portion which becomes narrow in the manner of a blade, wherein the end portion extends approximately tangentially and at a small distance from the roll surface, and wherein the end portion is constructed and arranged in such a way that a flow channel whose cross section expands steadily is formed between the end portion and the roll surface in the manner of an injector, wherein the flow channel extends parallel to the axis of the work roll at least over the width of the rolling stock.

The known devices and measures for producing dry strip frequently require a lot of energy, are complicated and present an obstacle when changing rolls as well as when adjusting the roll gap, and they produce a disturbing noise level.

In some cases, it was not possible to achieve a sufficient removal of the undesired moisture from the strip surface and, thus, a dry cold strip which meets all requirements because the reasons for precipitation and/or the entrainment of moisture on the strip surface were not taken sufficiently into consideration. The reasons are that rolling medium is entrained by the rolls and is flung onto the exiting strip, the rolling medium is sprayed next to the strip edge through the roll gap and reaches the strip once again in this manner, and mist in the exit area of the plant is condensed and drips back onto the strip.

On the other hand, in order to achieve a strip which is truly free of harmful moisture, a device for keeping the strip dry must be equipped with very complex means for simultaneously detecting all reasons for the precipitation of moisture on the surface of the exiting strip and to compensate for these reasons.

SUMMARY OF THE INVENTION

Therefore, it is the primary object of the present invention to provide an apparatus of the above-described type which is simple and can be configured of structural elements usable in rolling mills and which is capable of reliably preventing or removing moisture precipitation on the strip surface in the runout of cold rolling and strip rolling plants, which can be manufactured with a relatively small number of structural elements and so as to use not too much energy, which can be arranged in the area of the runout of a roll stand without problems, which does not present an obstacle during roll changes and adjustments of the roll gap, and which produces a relatively low noise level.

In accordance with the present invention, an apparatus for keeping cold strip dry in the runout of cold rolling and strip rolling plants includes means for deflecting liquid rolling medium in the area of the strip runout and/or for the removal of spray liquid adhering to the surfaces of the strip, wherein these means are logistically combined to form an operational unit, the apparatus including the following components:

a) a fixedly installed partition wall having an upper portion above the strip runout extending to the stand platform and a lower portion below the strip runout extending to the base plate;

b) a moveable partitioning means equipped with moveable components for facilitating a problem-free roll exchange;

c) a roll body blower constructed for deflecting squeezed-out rolling medium from the finish-rolled strip;

d) a roll body sealing means constructed for sealing the roll space above the strip relative to the strip;

e) a strip edge blower constructed for producing an air flow perpendicularly to the strip in the roll gap on the exit side above the strip runout; and f) a vapor-exhaust means for producing an air flow extending parallel to the strip travel direction above and below the strip in the strip channel.

The partition wall whose upper part extends above the strip to the stand platform and whose lower part extends below the strip to the base plate advantageously separates the moist roll area from the finish-rolled strip.

An additional moveable partitioning means composed of moveable components ensures a further separation of the moist roll area from the finish-rolled strip; however, because of the fact that the components are moveable, the rolls are accessible, for example, when carrying out a roll change. In addition, the moveable components serve as strip deflectors and/or as means for strip transfer. The moveable components constructed as stops can optionally be mechanically rigid or adjustable in dependence on the abrasion of the roll bodies.

The roll body blower prevents squeezed-off rolling medium from being transferred to the finish-rolled strip; the roll gap sealing means seals the roll space located above the strip relative to the finish-rolled strip; the strip edge blower produces a flow perpendicular to the strip in the roll gap on the runout side above the strip and deflects the entrained rolling oil laterally of the strip edges from the strip; the vapor-exhaust means in the strip channel removes the entire vapor above and below the strip by means of a counter-current air flow parallel to and above and below the strip. For this purpose, the exhaust line is constructed in such a way that a multiple of the air flow and the resulting vapor are drawn off together.

The cover of the strip channel can be folded away in order to make the strip more easily accessible, for example, after strip ruptures.

The synergistic interaction of these individual elements and the manner of operation of the elements adapted and constructed specifically for the practical application form the essential core of the invention. The apparatus can be constructed very advantageously of simple structural elements as they are used in rolling mills and the apparatus carries out the intended function in an optimum manner without requiring excessive energy, and it produces a truly dry product, i.e., cold strip, emerging from the roll stand.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

BRIEF DESCRIPTION OF THE DRAWING

In the drawing:

The single FIGURE of the drawing is a schematic illustration, partially in section, of the apparatus according to the present invention.

DESCRIPTION OF THE PREFERRED EMBODIMENTS

The drawing schematically shows an embodiment of the invention which constitutes a so-called DS-system or dry-strip system. Additional advantageous details are also shown in the drawing.

The drawing shows a pair of work rolls 33, 34 and two back-up rolls 31, 32 arranged above and below the work rolls. A roll gap 12 is defined between the work rolls 33, 34.

The apparatus for keeping cold strip dry in the runout of cold rolled strip plants has cooperating means for deflecting roll medium and moisture in the area of the strip runout 10 and/or for the removal of spray liquid adhering to the surfaces of the strip 30.

The apparatus according to the present invention is characterized by a logistically interacting combination of the aforementioned cooperating means to form a synergistically operating unit. This unit includes the following components:

a) a fixedly installed partition wall 1, 2 having an upper portion 1 above the strip runout 10 extending to the stand platform and a lower portion 2 below the strip runout 10 extending to the base plate;

b) a moveable partitioning means constructed with moveable components 20, 21 arranged above and below the strip runout 10, respectively, for facilitating a problem-free roll exchange;

c) a roll body blower 3 constructed for deflecting squeezed-out rolling medium from the finish-rolled strip 30;

d) a roll body sealing means 4 constructed for sealing the roll space 11 located above the strip 30 relative to the strip 30;

e) a strip edge blower 5 constructed for producing an air flow perpendicularly to the strip 30 in the roll gap 12 on the exit side above the strip runout 10; and f) a vapor-exhaust means 6 constructed for producing an air flow extending parallel to the strip travel direction 13 above and below the strip 30 in the strip channel 14.

The components 20, 21 of the moveable partitioning means are advantageously either pivotable or linearly displaceable. They are constructed with a double-lever arrangement 24 and a force application means 22 in such a way that the roll body blower 3 integrated with the moveable component 20 as well as the roll body sealing means 4 and the strip edge blower 5 can be simultaneously lifted off from the work roll 33 from the position shown in the drawing in the area of the work roll 33. The force application means 22 preferably is a pneumatic cylinder, however, it may also be a hydraulic cylinder or an electric adjustment drive.

Similarly, the moveable component 21 underneath the strip runout 10 can be pivoted about the axis 25 by the force application means 23.

Additionally, the upper cover 15 of the strip channel 14 can also be folded up. Since the elements of the moveable partitioning means and the cover 15 of the strip channel 15 are moveable, it is ensured that the work rolls 33, 34, the roll gap 12 as well as the strip 30 are accessible without problems and particularly without requiring time-consuming reassemblies.

It is apparent that the combination of all of the elements of the apparatus and the synergistic manner of operation specifically provided by the present invention constitute the essential feature of the invention.

The apparatus may preferably cooperate with a roll gap lubricating unit which operates in dependence on the band width, irrespective of whether the rolls are axially fixed or displaceable or whether the rolls intersect.

The apparatus is constructed in such a way that moisture in the form of droplets or vapor precipitation is safely prevented from dropping back onto the strip 30 and, thus, the strip quality is optimized. This is achieved in a decisive manner by the suction flow produced in the strip channel 14 in a direction opposite the strip travel direction 13 by the vapor-exhaust means 6 in cooperation with the roll body sealing means 4 and the roll body blower 3 in the roll space 11 above the strip 30.

The apparatus forms a functional unit or a system composed of simple structural elements usable in rolling mills and produces a dry strip with a feasible amount of energy. Consequently, the present invention meets the object mentioned above in an optimum manner.

While specific embodiments of the invention have been shown and described in detail to illustrate the inventive principles, it will be understood that the invention may be embodied otherwise with-out departing from such principles.

We claim:

1. An apparatus for keeping cold strip dry in a runout of a cold rolling plant or strip rolling plant by deflecting liquid rolling medium in the area of the strip runout and by removing spray liquid adhering to surfaces of the strip, the apparatus comprising the following components which act together to form a synergistically operating unit;

a) a fixedly installed partition wall having an upper portion above the strip runout extending to a stand platform and a lower portion below the strip runout extending to a base plate;

b) a moveable partitioning means comprising moveable components so as to facilitate a problem-free roll exchange;

c) a roll body sealing means for sealing a roll space above the strip relative to the strip:

d) a roll body blower for deflecting squeezed-out rolling medium from the finish-rolled strip;

e) a strip edge blower for producing an air flow perpendicularly to the strip in a roll gap on an exit side above the strip runout; and f) a vapor-exhaust means for producing an air flow parallel to a strip travel direction above and below the strip in a strip channel.

2. The apparatus according to claim 1, wherein the moveable components of the moveable partitioning means are mounted so as to pivotable.

3. The apparatus according to claim 1, wherein the moveable components of the moveable partitioning means are mounted so as to be linearly displaceable.

4. The apparatus according to claim 1, wherein at least one of the moveable components is a strip deflector.

5. The apparatus according to claim 1, comprising cylinders for moving the moveable components.

6. The apparatus according to claim 1, wherein the roll body blower, the roll body sealing means and the strip edge blower are mounted so as to be integrated with one of the moveable components of the moveable partitioning means located above the strip.

7. The apparatus according to claim 1, wherein the strip channel comprises a foldable upper cover.

8. The apparatus according to claim 1, comprising a roll gap lubricating unit operable in dependence of a strip width.

* * * * *